US007815746B2

(12) United States Patent
Lee et al.

(10) Patent No.: US 7,815,746 B2
(45) **Date of Patent: *Oct. 19, 2010**

(54) DISHWASHER AND METHOD OF SUPPLYING WATER OF DISHWASHER

(75) Inventors: Tae Hee Lee, Boocheon-si (KR); Sang Heon Yoon, Gwangmyung-si (KR)

(73) Assignee: LG Electronics Inc., Seoul (KR)

( * ) Notice: Subject to any disclaimer, the term of this patent is extended or adjusted under 35 U.S.C. 154(b) by 710 days.

This patent is subject to a terminal disclaimer.

(21) Appl. No.: 11/604,392

(22) Filed: Nov. 27, 2006

(65) Prior Publication Data

US 2007/0131261 A1 Jun. 14, 2007

(30) Foreign Application Priority Data

Nov. 28, 2005 (KR) ..... 10-2005-0114253
Dec. 15, 2005 (KR) ..... 10-2005-0123704

(51) Int. Cl.
*B08B 3/00* (2006.01)

(52) U.S. Cl. ..... 134/56 D; 134/57 D; 134/58 D

(58) Field of Classification Search ..... None
See application file for complete search history.

(56) References Cited

U.S. PATENT DOCUMENTS

2004/0244432 A1* 12/2004 Kim et al. ..... 68/5 C
2005/0236020 A1 10/2005 Bang
2005/0241683 A1 11/2005 Jeong

FOREIGN PATENT DOCUMENTS

WO WO 2004058035 A1 * 7/2004

OTHER PUBLICATIONS

Stickel, Martin, WO 2004/058035A1, Jul. 2004, English machine translation.*

* cited by examiner

*Primary Examiner*—Michael Barr
*Assistant Examiner*—Jason Y. Ko
(74) *Attorney, Agent, or Firm*—McKenna Long & Aldridge LLP

(57) ABSTRACT

Provided are a dishwasher and a method of supplying water in the dishwasher. The dishwasher includes a tub enclosing a washing chamber, a sump holding washing water to be supplied to the tub, and an air brake assembly having a steam generating unit that heats the washing water to be supplied to the tub.

12 Claims, 5 Drawing Sheets

DISHWASHER AND METHOD OF SUPPLYING WATER OF DISHWASHER

This application claims the benefit of Korean Patent Application Nos. 10-2005-0114253, filed on Nov. 28, 2005, and 10-2005-0123704, filed on Dec. 15, 2005, which are incorporated by reference for all purposes as if fully set forth herein.

BACKGROUND OF THE INVENTION

1. Field of the Invention

The present invention relates to a dishwasher and, more particularly, to a dishwasher, in which a steam generator is integrally formed with an air brake assembly and which may allow the remaining water used in steam washing to effectively flow in to a tub by simplifying a passage formed in the air brake assembly.

2. Discussion of the Related Art

Generally, a dishwasher is a machine that washes and dries dishes by spraying washing water with high pressure in a tube so that the sprayed water contacts the dishes to remove foreign objects such as food waste from the surface of the dishes. The removed food wastes are filtered off by a filter to reuse the washing water. Detergents are dissolved in the washing water so that the food wastes can be effectively removed from the dishes.

Meanwhile, a variety of schemes for improving the washing efficiency of the dishwasher have been proposed.

For example, the washing efficiency may be improved by heating the washing water and thus more effectively dissolving the detergent in the washing water. By spraying high temperature water, the hardened food wastes may be more effectively removed from the dishes.

A pre-washing cycle may be added to the inherent cycles of the dishwasher so that the food waste swells, thereby improving the reliability of the washing.

However, in spite of these schemes, there is a limit to increasing the washing efficiency of the dishwasher. Particularly, it is more difficult to effectively wash the dishes when the food waste adhered to the dishes is hardened.

Accordingly, a device for swelling the hardened food wastes, such as a steam generating device and other relevant components, may be included in the dishwasher to swell the food wastes.

The steam generating device may include a steam chamber and a heater. The steam generating device is typically installed in a lower mechanical chamber of the dishwasher. In the steam generating device, washing water is retained in the steam chamber, and the steam is generated by a heater immersed in the retained washing water. The steam generated by the steam generating device is sprayed toward dishes in the tub through a steam passage connected to the tub containing a washing chamber.

The steam generating device is designed to retain water remaining in the steam chamber. When the remaining water stays in the steam generating device for a long time, it may be decomposed.

Furthermore, because the steam passage between the steam generating device and the steam spraying portion is separately formed, the manufacturing process is complicated and the manufacturing cost increases. In addition, because the steam passage between the steam generating device and the steam spraying portion is long, energy efficiency decreases due to heat loss while the steam flows through the steam passage.

SUMMARY OF THE INVENTION

Accordingly, the present invention is directed to a dishwasher and method of supplying water to dishwasher that substantially obviates one or more problems due to limitations and disadvantages of the related art.

An advantage of the present invention is to provide a dishwasher, in which the distance between a steam generating unit and a steam spraying unit is shorted and no washing water remains in a steam chamber after the steam is generated.

Another advantage of the present invention is to provide a dishwasher that can improve the steam spraying force by placing a steam generating unit at a location higher in the dishwasher to reduce the length of a steam passage thereby reducing the manufacturing cost thereof.

Additional features and advantages of the invention will be set forth in the description that follows and in part will be apparent from the description, or may be learned from practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided a dishwasher including: a tub enclosing a washing chamber; a sump holding washing water to be supplied to the tub; and an air brake assembly having a steam generating unit that heats the washing water to be supplied to the tub.

In another aspect of the present invention, there is provided a dishwasher including: a tub defining a washing chamber; a sump holding washing water to supplied to the tub; and an air brake assembly having a steam generating unit that heats the washing water to be supplied to the tub, wherein the steam generating unit is integrally formed in the air brake assembly, wherein the air brake assembly includes a tub passage that directly supplies water remaining in the steam generating unit to the tub after the steam washing is completed.

In still another aspect of the present invention, there is provided a dishwasher including: a tub defining a washing chamber; a sump holding washing water to be supplied to the tub; and an air brake assembly having a steam generating unit that heats the washing water to be supplied to the tub, wherein the steam generating unit is integrally formed in the air brake assembly, wherein the air brake assembly includes a tub passage that directly supplies water remaining in the steam generating unit to the sump after the steam washing is completed.

In still yet another aspect of the present invention, there is provided a method of supplying water to a dishwasher, including: supplying washing water from a water source to a steam generating unit formed in an air brake assembly through a water supply passage; supplying steam generated in the steam generating unit to a tub through a steam passage during a steam washing cycle; and supplying water remaining in the steam generating unit to one of a sump and tub after the steam washing is completed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings that are included to provide a further understanding of the invention and are incorporated in and constitute a part of this specification, illustrate embodiment(s) of the invention and together with the description serve to explain the principle of the invention.

In the drawings.

DETAILED DESCRIPTION OF THE ILLUSTRATED EMBODIMENTS

Reference will now be made in detail to an embodiment of the present invention, examples that are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
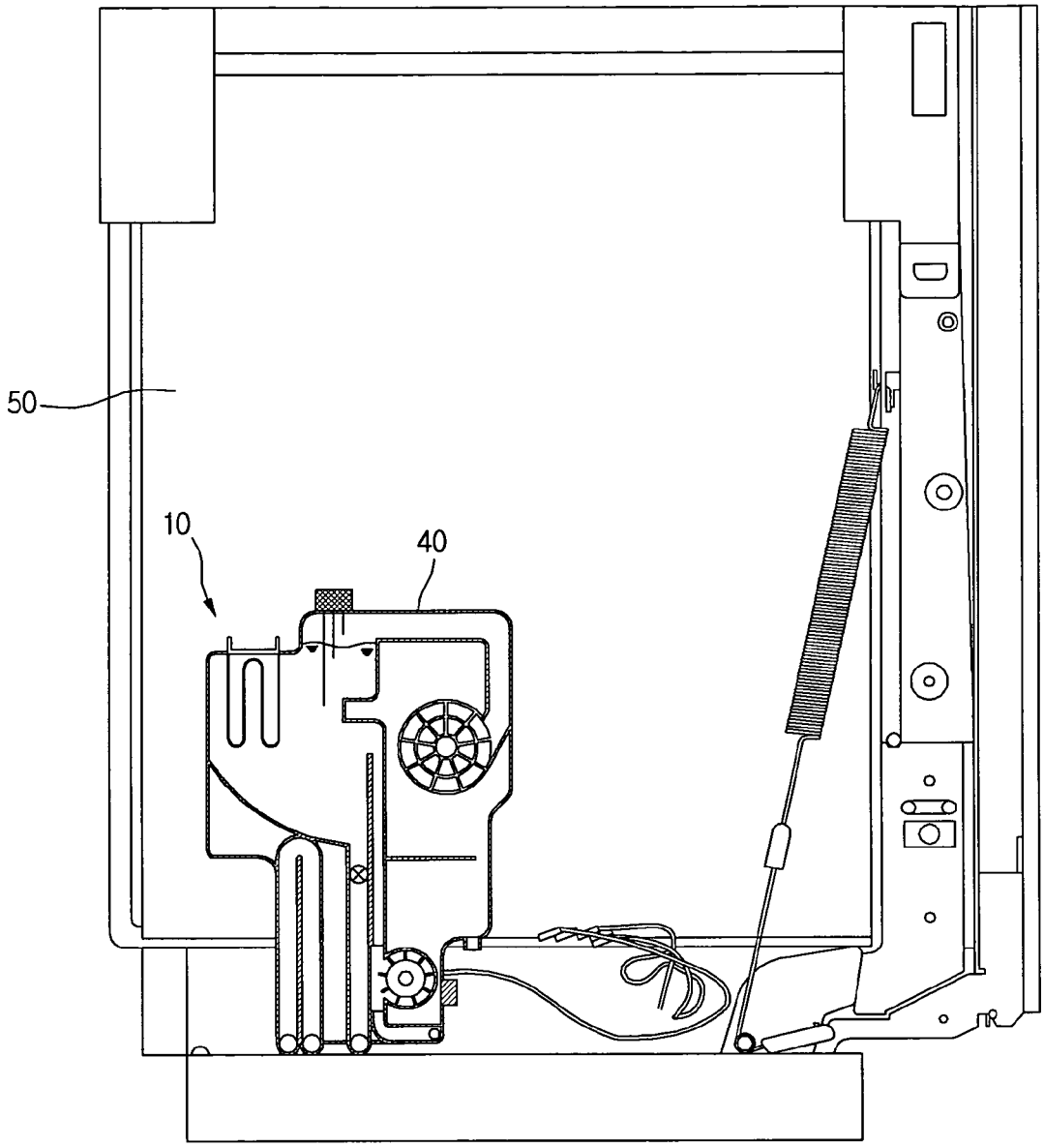
FIG. 1 is a sectional view of a dishwasher where a steam generating unit is integrally formed with an air brake assembly according to an embodiment of the present invention.

FIG. 1 is a sectional view of a dishwasher where a steam generating unit is integrally formed with an air brake assembly.

Referring to FIG. 1, a dishwasher 1 includes a tub defining a washing chamber and an air brake assembly 40 having a steam generating unit 10 for heating washing water that will be supplied to the tub 50.

The dishwasher 1 further includes a sump (60 of FIG. 3) in which the washing water is retained. The sump 60 may be mounted on a bottom center of the tub 50.

The air brake assembly 40 is disposed on a side surface of the dishwasher 1 to perform a variety functions such as adjusting a water supply, adjusting pressure in the tub, and external air suction.

Figure 2:
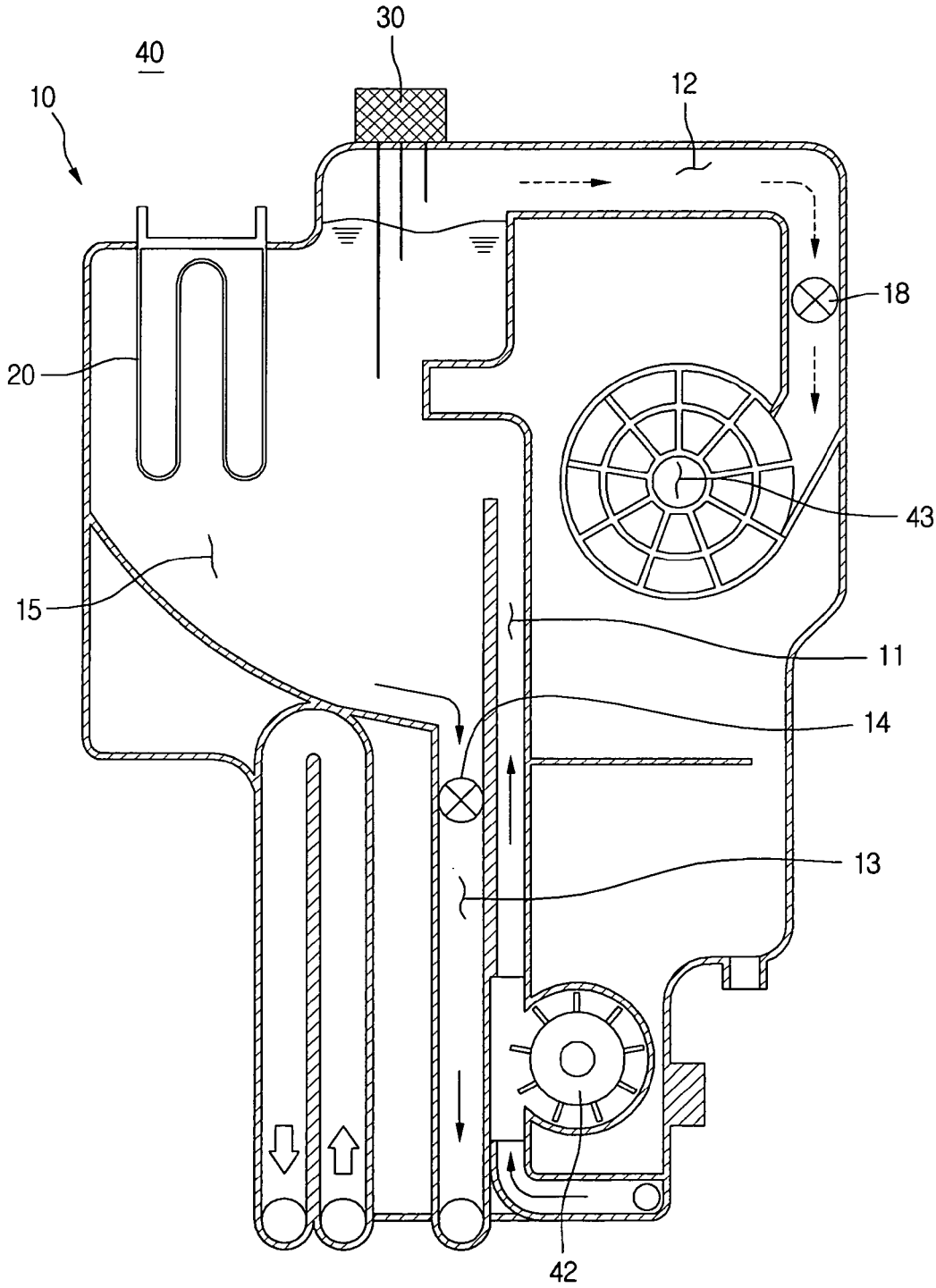
FIG. 2 is a schematic view illustrating a washing water flow path in a dishwasher according to an embodiment of the present invention.

FIG. 2 is a schematic view of a washing water flow path in the dishwasher.

Referring to FIG. 2, the air brake assembly 40 with the integral steam generating unit 10 includes a water supply passage 11 through which the washing water is supplied from an external water source to the steam generating unit 10, a steam passage 12 through which the steam generated from the steam generating unit 10 is supplied to the tub 50, and a sump passage 13 through which the remaining water of the steam generating unit 10 is supplied to the sump 60 after the steam washing is finished.

The washing water is supplied through the water supply passage 11 from the external water source to the air brake assembly 40. A flow meter 42 is at an inlet of the water supply passage 11 formed in the air brake assembly 40. The flow meter 42 rotates as the washing water passes to measure an amount of the water that is supplied.

The steam generating unit 10 is on an inner-upper potion of the air brake assembly 40. The steam generating unit 10 includes a steam chamber 15 having a heater 20 heating the washing water. In addition, a water level sensor 30 for detecting the amount of washing water in the steam chamber 15 is in the steam generating unit 10.

When the washing water level reaches a predetermined amount or more, the steam generating unit 10 heats the washing water using the heater 20 and supplies the steam into the tub 50 through the steam passage 12.

The steam passage 12 is connected to the tub communication hole 43 through the steam generating unit 10 and the side surface of the tub 50. The steam passage 12 functions as a connection tube through which the steam generated in the steam generating unit 10 enters into the tub 50.

A steam valve 18 is mounted on the downstream of the steam passage 12. The steam valve 18 is opened only when the steam is supplied to the steam chamber 15.

When the steam washing is not being performed, the steam valve 18 is closed. Accordingly, in the normal cycles such as a washing cycle and a rinsing cycle, the polluted washing water cannot be directed into the steam generating unit 10 through the steam passage 12.

The steam valve 18 prevents the polluted washing water and foreign objects from entering and remaining in the steam passage 12, thereby preventing the growth of microorganisms that may cause foul odors and thus keeping the dishwasher clean.

The sump passage 13 is a connection passage through which high temperature washing water is supplied to the sump (60 of FIG. 3) when the steam supply cycle is completed. One end of the sump passage 13 is connected to the steam chamber 15 and the other end is connected to the sump 60. The washing water directed to the sump 60 through the sump passage 13 is sprayed into the tub 50 through a spraying nozzle (not shown) connected to the sump 60. Therefore, the sump passage 13 may also be called a tub passage through which the washing water is supplied into the tub.

The sump passage 13 includes a sump passage discharge valve 14. The sump passage discharge valve 14 is closed when the washing water is being supplied into the steam chamber 15, the washing water reserved in the steam chamber 15 is being heated, or the steam is being generated during steam washing. On the contrary, the sump passage discharge valve 14 is opened when the washing water is being supplied to the sump 60.

After the steam washing is completed, the high temperature washing water remaining in the steam chamber 15 is directed into the sump 60 so that the high temperature washing water can be reused.

Figure 3:
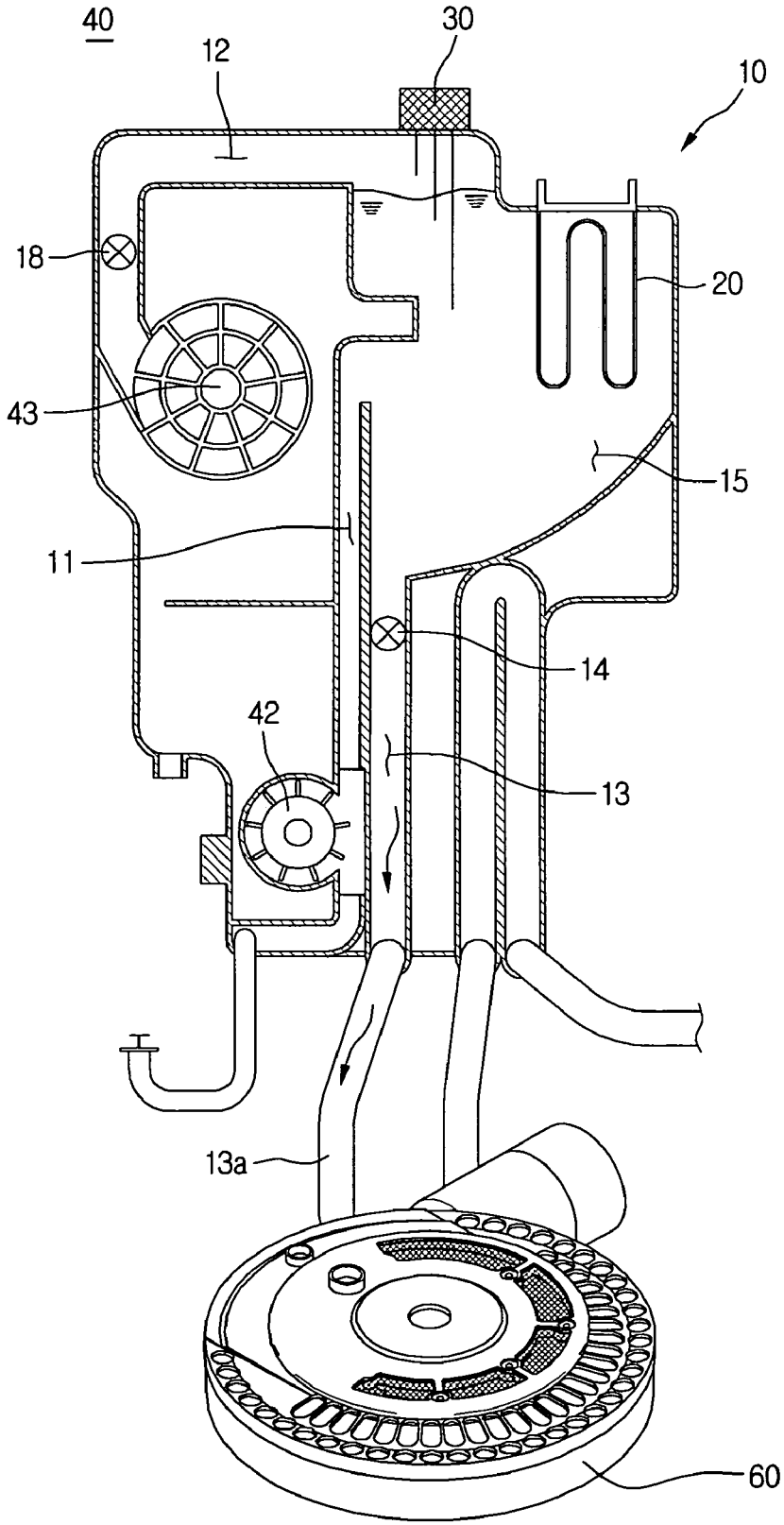
FIG. 3 is a schematic view illustrating a connection structure of an air brake assembly having a steam generating unit to a sump in a dishwasher according to an embodiment of the present invention.

FIG. 3 is a schematic view illustrating a connection structure of the air brake assembly having a steam generating unit to the sump in the dishwasher according to an embodiment of the present invention.

Referring to FIG. 3, the water supply passage 11 is connected to as external water source and the steam generating unit 10. The steam passage 12 is connected to the steam generating unit 10 and the tub communication hole 43 formed in the air brake assembly 40. The sump passage 13 is connected to the steam generating unit 10 and the sump 60.

The steam passage 12 is formed in the air brake assembly 40. The water supply passage 11 and the sump passage 13 are partly formed in the air brake assembly 40. The sump passage 13 is connected to the sump 60 through a lower passage 13*a*.

A steam valve 18 is in the steam passage 12. The steam valve 18 is opened when the steam is supplied to the tub 50. The sump passage discharge valve 14 that is opened when the washing water is supplied to the sump is in the sump passage 13.

The steam generating process and the remaining water discharging process carried out by the above-described structure will now be briefly described.

When the sump passage discharge valve 14 is closed, the washing water is supplied to and retained in the steam chamber 15 through the water supply passage 11. Then, the retained water is heated by the heater 30 to produce steam. The steam is supplied into the tub 50 through the tub communication hole 43.

After the steam production is completed, the sump passage discharge valve 14 is opened to supply the high temperature washing water in the steam chamber 15 into the sump 60 through the sump passage 13 and the lower passage 13*a* of the sump passage 13.

The high temperature washing water supplied to the sump 60 is sprayed into the tub 50 through the spraying nozzle connected to the sump 60. The high temperature washing water is reused for the washing cycle together with other washing water that is directly supplied from the water source to the sump 60. Alternatively, the washing water supplied into the sump 60 may be completely supplied into the sump 60 via the steam generating unit 10.

Figure 4:
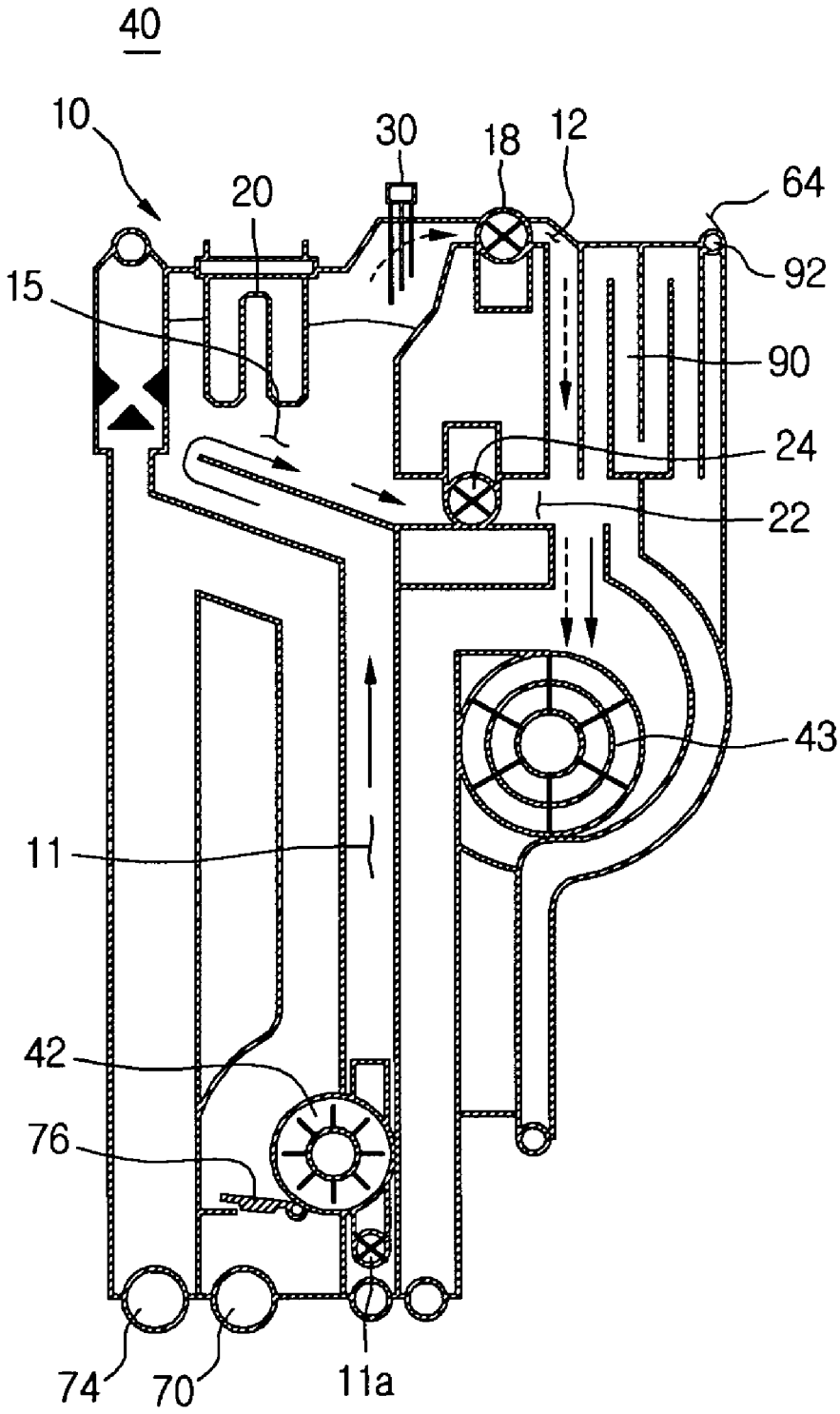
FIG. 4 is a schematic view of a washing water flow path in a dishwasher according to another embodiment of the present invention.

FIG. 4 is a schematic view of a washing water flow path in a dishwasher according to another embodiment of the present invention.

Referring to FIG. 4, an air brake assembly 40 that is integrally formed with a steam generating unit 10 includes a water supply passage 11 through which the washing water is supplied from an external water source to the steam generating unit 10, a steam passage 12 through which the steam produced by the steam generating unit 10 is supplied to the tub 50, and a tub passage 22 through which the remaining water in the steam generating unit 10 is supplied to a tub 50 after the steam washing is finished.

The water supply passage 11 is a washing water supply passage through which the washing water is supplied from the external water source to the air brake assembly 40. A flow meter 42 is at an inlet side of the water supply passage 11 formed in the air brake assembly 40. The flow meter 42 rotates as the washing water passes by and measures the amount of the water which is supplied.

The steam generating unit 10 is at an inner-upper potion of the air brake assembly 40. The steam generating unit 10 includes a steam chamber 15 having a heater 20 heating the washing water. In addition, the steam generating unit 10 includes a water level sensor 30 for detecting the amount of the washing water supplied into the steam chamber 15. The water level sensor 30 functions to uniformly maintain the water level in the steam chamber 15 while the heater 20 operates.

When the washing water reaches a predetermined level, the steam generating unit 10 heats the washing water using the heater 20 and supplies the steam into the tub 50 through the steam passage 12.

The steam passage 12 is connected to the tub communication hole 43 through the steam generating unit 10 and the side surface of the tub 50. The steam passage 12 functions as a connection tube through which the steam produced by the steam generating unit 10 enters into the tub 50.

A steam valve 18 is in the steam passage 12. The steam valve 18 is opened only when the steam is produced by the steam chamber 15.

Meanwhile, when the steam washing cycle is not operating, the steam valve 18 is closed. Accordingly, in the normal cycles such as a washing cycle and a rinsing cycle, the polluted washing water cannot enter into the steam generating unit 10 through the steam passage 12.

The steam valve 18 may prevent the polluted washing water and foreign objects from entering and remaining in the steam passage 12, thereby preventing the propagation of the microorganisms that may cause foul odors and thus keeping the dishwasher clean.

The tub passage 22 is a connection passage through which high temperature washing water which remains after the steam supply cycle is finished, is supplied to the tub 50 through the tub communication hole 43. One end of the tub passage 22 is connected to the steam chamber 15 and the other end is connected to the tub 43. The washing water directed to the tub 50 through the tub passage 22 is sprayed into the tub 50 through a spraying nozzle (not shown) connected to the sump 60.

A steam chamber water discharge valve 24 is further installed on the sump passage 13. The steam chamber discharge valve 24 is closed when the washing water is supplied into the steam chamber 15, the washing water retained in the steam chamber 15 is heated, or the steam is produced during the steam washing. On the contrary, the steam chamber water discharge valve 24 is opened when the washing water is supplied to the tub 50.

After the steam washing is completed, the high temperature washing water remaining in the steam chamber 15 is drained into the tub 50 through the tub passage 22 so that the high temperature water may be reused in the washing cycle.

Meanwhile, an ambient path 90 is downstream from the steam passage 12 and the steam valve 18. The ambient path 90 has a zig-zag structure that is a steam obstacle.

During the steam washing cycle, a part of the steam generated from the steam generating unit 10 is discharged through the ambient path 90 and the steam discharge hole 92 at a far end of the ambient path 90. The steam discharge hole 92 is covered by a discharge cover 64 and the discharge cover 64 is opened by the pressure of the steam that is being discharged.

In addition, during the high temperature washing cycle, a high temperature/pressure state exists inside of the tub 50. At this point, vapor may be generated in the tub 50 and directed into the air brake assembly 40 through the tub communication hole 43. The vapor is discharged out side the washer through the ambient path 90 and the steam discharge hole 92.

The ambient path 90 reduces the pressure in the tub 50 in the high temperature cycle to stably operate the dishwasher.

Figure 5:
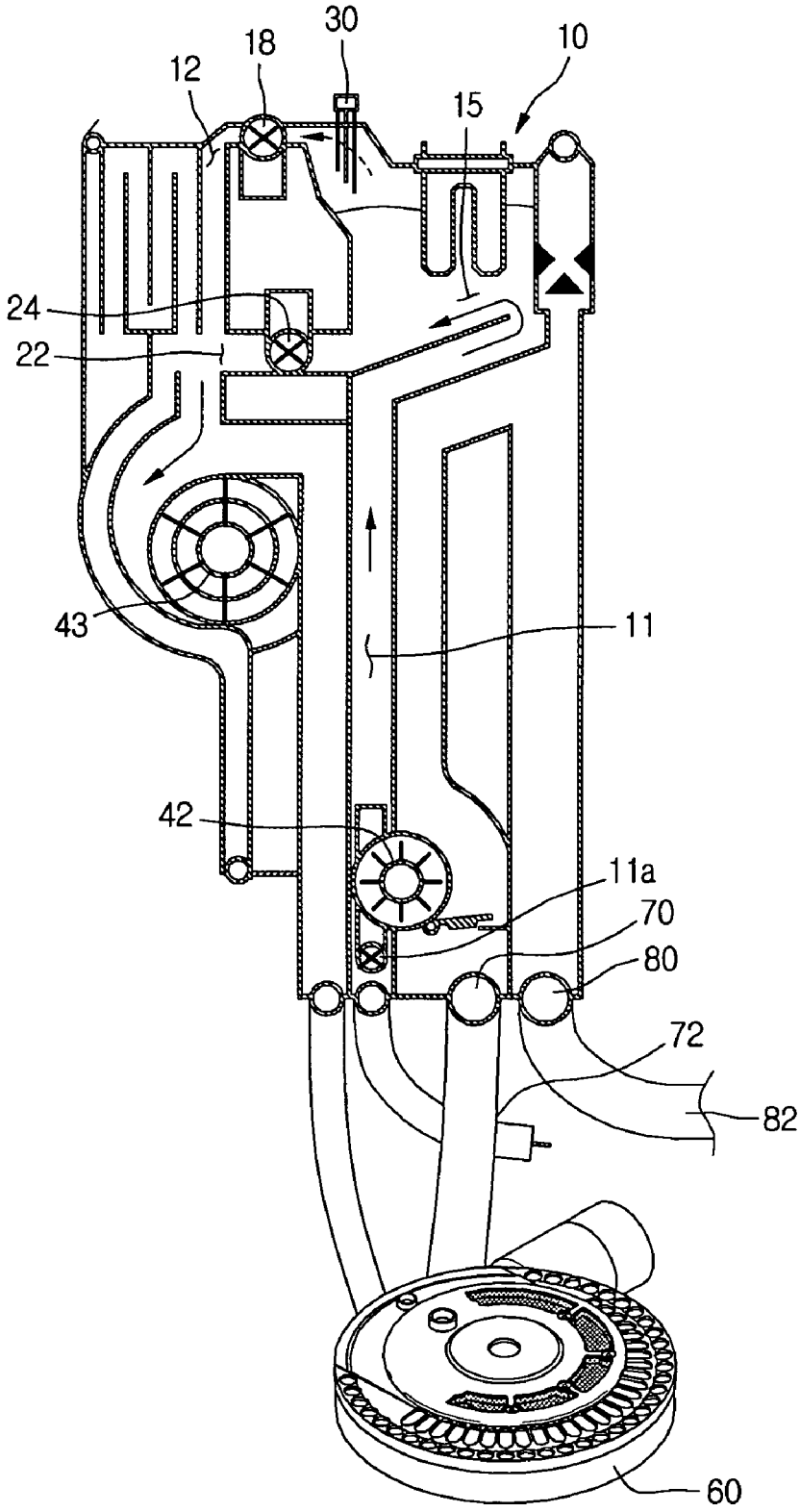
FIG. 5 is a schematic view illustrating a connection structure of an air brake assembly having a steam generating unit to a sump in a dishwasher according to another embodiment of the present invention.

FIG. 5 is a schematic view illustrating a connection structure of an air brake assembly having a steam generating unit to a sump in a dishwasher according to another embodiment of the present invention.

A water supply passage 11 is connected to a water supply source and a steam generating unit 10. The steam passage 12 is connected to the steam generating unit 10 in the air brake assembly 40 and the tub communication hole 43, and the tub passage 22 is connected to the tub communication hole 43 and the steam generating unit 10.

The steam passage 12 and the tub passage 22 are in the air brake assembly 40. The water supply passage 11 is partly in the air brake assembly 40.

The steam passage 12 includes a steam valve 18 that is opened when the steam is supplied into the steam passage 12, and the tub passage 22 includes a remaining water discharge valve 24 that is opened when the washing water is supplied to the sump.

The steam generating process and the remaining water discharging process by the above-described structure will now be briefly described.

If the steam chamber water discharge valve 24 is closed, the washing water is supplied to and retained in the steam chamber 15 through the water supply passage 11. Then, the retained water is heated by the heater to produce steam. The steam is supplied into the tub 50 through the tub communication hole 43.

After the steam production is complete, the steam chamber water discharge valve 24 is opened to supply the high temperature washing water remaining in the steam chamber 15 into the tub 50.

The high temperature washing water supplied to the tub 50 is reused for the washing cycle together with other washing water that is directly supplied from the water source to the sump 60.

The water supply method of the dishwasher of the present invention will be described hereinafter with reference to FIGS. 2 through 5.

When the remaining water of the steam generating unit 10 flows into the sump 60, the washing water supplied from the water source 5 is directed to the steam generating unit 10 through the water supply passage 11. In the steam washing cycle, the steam produced from the steam generating unit 10 is directed to the tub 50 through the steam passage 12. After the steam washing is completed, the high temperature washing water produced in the steam generating unit 10 is directed to the sump 60 through the sump passage 13. The washing water directed to the sump 60 is sprayed into the tub 50 through the spraying nozzle connected to the sump 60.

When the remaining water of the steam generating unit 10 is directed into the tub, the washing water supplied from the water source 10 is directed to the steam generating unit 10 through the water supply passage 11. In the steam cycle, the steam produced by the steam generating unit 10 is directed to the tub 50 through the steam passage 12. After the steam washing is completed, the high temperature water remaining in the steam chamber 15 is directed to the tub 50 through the tub passage 22.

When the steam generating unit is integrally formed in the air brake assembly, the lengths of the steam passage, steam passage, and remaining water discharge passage are reduced. Therefore, the heat loss occurring during the flow of the washing water can be reduced. In addition, space utilization may be improved as compared with the situation where the steam generating unit is disposed an outside of the air brake assembly. In addition, because the steam passage is formed in the air brake assembly, the manufacturing cost for the steam passage may be reduced.

Because the water remaining in the steam chamber can be completely discharged to the sump or tub, the bacterial growth in the steam chamber can be prevented. Furthermore, when the remaining heated water is added to the washing water from an external source, the energy consumption for the high temperature washing cycle may be reduced.

It will be apparent to those skilled in the art that various modifications and variations can be made in the present invention without departing form the spirit or scope of the invention. Thus, it is intended that the present invention cover the modifications and variations of this invention provided they come within the scope of the appended claims and their equivalents.

What is claimed is:

1. A dishwasher comprising:

a tub enclosing a washing chamber;

a sump holding washing water to be supplied to the tub;

an air break assembly having a steam generating unit including a steam chamber having a heater to heat washing water to be supplied to the tub wherein a part of the steam generating unit is disposed at a side of the tub;

a water supply passage formed in the air break assembly, through which washing water is supplied to the steam generating unit;

a steam passage formed in the air break assembly and located higher than the water supply passage, through which the steam generated by the steam generating unit is supplied to the tub, wherein the steam passage can be openable through a steam valve when the steam is supplied to the steam chamber; and a tub passage that directly supplies water remaining in the steam generating unit to the sump, wherein the tub passage can be closable through a discharge valve when the steam is supplied to the steam chamber.

2. The dishwasher according to claim 1, wherein the water supply assembly includes a water level sensor that detects an amount of the water supplied to the steam generation unit.

3. The dishwasher according to claim 1, wherein the steam generating unit is adjacent to a tub communication hole through which steam is supplied to the tub.

4. A dishwasher comprising:

a tub defining a washing chamber;

a sump holding washing water to be supplied to the tub;

an air break assembly having a steam generating unit including a steam chamber having a heater to heat washing water to be supplied to the tub, wherein the steam generating unit is integrally formed in the air break assembly, wherein the air break assembly includes:

a steam passage that extends toward one direction from the steam chamber to supply steam to the tub; and a tub passage that directly supplies water remaining in the steam generating unit to the sump, wherein at least one part of the tub passage extends toward another direction.

5. The dishwasher according to claim 4, wherein the steam generating unit includes a steam valve that is opened when the steam is supplied to the tub.

6. The dishwasher according to claim 4, wherein the water supply assembly includes a steam generating unit discharge valve in the tub passage that is opened to supply water remaining in the steam generating unit to the tub.

7. The dishwasher according to claim 4, wherein the water supply assembly includes a water level sensor that detects an amount of the water supplied to the steam generation unit.

8. The dishwasher according to claim 4, wherein the steam generating unit is adjacent to a tub communication hole through which steam is supplied to the tub.

9. A dishwasher comprising:

a tub enclosing a washing chamber;

a sump holding washing water to be supplied to the tub;

a communication hole configured to be connected to the tub; and an air break assembly comprising;

a steam generating unit that heats water to generate steam;

a steam passage configured to supply steam to the tub, the steam passage having a first end connected to the steam generating unit and a second end connected to the communication hole, wherein the first end is higher than the second end to supply steam downward;

a water supply passage that supplies water to the steam generating unit; a heater disposed in the steam generating unit; and a tub passage that directly supplies water remaining in the steam generating unit to the sump, wherein the tub passage is located lower than the steam passage.

10. A dishwasher according to claim 9, wherein the steam passage includes a valve which keeps polluted washing water from entering the steam generating unit.

11. A dishwasher according to claim 9, further comprising;

a water level sensor detecting a water level in the steam generating unit and is disposed at an upper part of the air break assembly.

12. A dishwasher according to claim 9, wherein the heater is disposed at an upper part of the air break assembly.

* * * * *